US011683636B2

(12) United States Patent
Casadei et al.

(10) Patent No.: US 11,683,636 B2
(45) Date of Patent: Jun. 20, 2023

(54) COAXIAL COMPRESSION DRIVER

(71) Applicant: B&C SPEAKERS S.p.A., Bagno a Ripoli (IT)

(72) Inventors: Andrea Casadei, Bagno a Ripoli (IT); Valentina Cardinali, Bagno a Ripoli (IT)

(73) Assignee: B & C SPEAKERS S.P.A., Bagno a Ripoli (IT)

( * ) Notice: Subject to any disclaimer, the term of this patent is extended or adjusted under 35 U.S.C. 154(b) by 0 days.

(21) Appl. No.: 17/750,526

(22) Filed: May 23, 2022

(65) Prior Publication Data

US 2022/0286769 A1 Sep. 8, 2022

Related U.S. Application Data

(63) Continuation of application No. 16/655,498, filed on Oct. 17, 2019, now Pat. No. 11,343,608.

(30) Foreign Application Priority Data

Oct. 26, 2018 (IT) ..... 102018000009821

(51) Int. Cl.
*H04R 1/24* (2006.01)
*H04R 1/30* (2006.01)
*H04R 9/06* (2006.01)

(52) U.S. Cl.
CPC ..... *H04R 1/24* (2013.01); *H04R 1/30* (2013.01); *H04R 9/063* (2013.01)

(58) Field of Classification Search
None
See application file for complete search history.

(56) References Cited

U.S. PATENT DOCUMENTS

2004/0005069 A1* 1/2004 Buck ..... H04R 1/30 181/177
2010/0027828 A1* 2/2010 Vercelli ..... H04R 1/2826 381/345
2011/0085692 A1* 4/2011 Voishvillo ..... H04R 1/345 381/343
2013/0243232 A1* 9/2013 Dimitrov ..... H04R 1/323 381/340
2018/0255399 A1* 9/2018 Voishvillo ..... H04R 1/28

* cited by examiner

*Primary Examiner* — Walter F Briney, III
(74) *Attorney, Agent, or Firm* — Cantor Colburn LLP

(57) ABSTRACT

A coaxial compression driver including a housing, a first vibrating membrane for lower frequencies housed in the housing and facing a first compression chamber in communication with a first acoustic conduit, a second vibrating membrane for higher frequencies housed in the housing and facing a second compression chamber in communication with a second acoustic conduit, and a passive acoustic low pass filter housed in the first acoustic conduit, where the first and second vibrating membranes are arranged in the housing coaxial with respect to each other, where the first and second acoustic conduits converge into a common output acoustic conduit, and where the passive low pass filter is a lumped parameters filter which prevents frequencies above a predetermined cutoff frequency from passing from the second to the first acoustic conduit and allows frequencies below the predetermined cutoff frequency to pass from the first to the common output acoustic conduit.

8 Claims, 5 Drawing Sheets

COAXIAL COMPRESSION DRIVER

CROSS REFERENCE TO RELATED APPLICATIONS

This application is a continuation of U.S. patent application Ser. No. 16/655,498 filed on Oct. 17, 2019, now, U.S. Pat. No. 11,343,608 issued on May 24, 2022, claiming priority to Italian Patent Application Number 102018000009821 filed on Oct. 26, 2018, the contents of all of which said applications are incorporated herein by reference in their entirety.

FIELD OF THE INVENTION

The present invention relates to the technical field of audio reproduction systems, and in particular relates to a coaxial compression driver.

BACKGROUND ART

An electroacoustic transducer is a device of a sound system adapted to convert an electrical signal into acoustic waves. A particular type of known acoustic transducers comprises at least one sound source, such as, for example, a compression driver, and an acoustic waveguide, referred to as a horn.

The horn comprises an internally hollow main body which extends between an input opening adapted to receive acoustic radiation and an output opening for the diffusion of said acoustic radiation outside the horn. The main body has internal walls which delimit a flared conduit which allows the propagation of acoustic radiation between the input opening and the output opening. The input opening is generally referred to as a throat while the output opening is generally referred to as a mouth.

In some acoustic transducers, at least one coaxial compression driver may be fastened to the horn throat.

A coaxial compression driver generally comprises a housing which houses a first vibrating membrane for relatively higher frequencies, for example for high frequencies, and a second vibrating membrane for relatively lower frequencies, for example for low and/or medium frequencies. The first membrane and the second membrane are coaxial or substantially coaxial with respect to each other. The first vibrating membrane faces a first compression chamber in communication with a first acoustic conduit. Similarly, the second vibrating membrane faces a second compression chamber in communication with a second acoustic conduit. The first and second acoustic conduits are initially separated and converge into a common output acoustic conduit. Such a common acoustic conduit conducts an acoustic wave resulting from the acoustic waves produced by the first and second vibrating membrane up to the output port of the coaxial compression driver and, therefore, up to the entrance of the horn. The set of compression chambers and acoustic conduits forms what is commonly referred to as a phase plug, i.e., a known component which allows the frequency response to be extended upwards, better conveying acoustic waves towards the horn, reducing destructive interference.

A coaxial compression driver of the type mentioned above is described in Patent EP 2 640 089 B1.

In known coaxial compression drivers, at the point in which the two aforesaid acoustic conduits join, phenomena of acoustic interference, in particular resonance inside the structure, occur, affecting the quality of the frequency response. The effect of this interference is particularly noticeable in the frequency response of the vibrating membrane for relatively higher frequencies and depends on the actual distance between the two vibrating membranes.

Document US2006/285712 describes a loudspeaker comprising a coaxial driver contained in a housing, a horn and an acoustic transformer arranged outside the housing between the coaxial driver and the horn. This solution has the disadvantage of being not very compact.

Document U.S. Pat. No. 4,619,342 in FIG. 8 describes a loudspeaker system having an external low frequency loudspeaker and an internal high frequency loudspeaker. Each speaker has its own perforated horn. The set of the two horns constitutes an acoustic filter. In any case the document U.S. Pat. No. 4,619,342 describes a complex loud speaker and not a coaxial compression driver. Moreover, also with reference to the alternative embodiments of the aforementioned loudspeaker system described with reference to FIGS. 11 and 12 of document U.S. Pat. No. 4,619,342, it should be noted that such embodiments do not refer to coaxial compression drivers.

Document WO03086016 describes the use of an acoustic filter between two separate and non-coaxial drivers, respectively between a high-frequency driver and a low-frequency driver. Therefore, this document does not describe a coaxial compression driver.

It is the object of the present description to provide a coaxial compression driver which is capable of overcoming or at least partially reducing the drawbacks described above with reference to the coaxial compression drivers of the background art.

Such an object is achieved by means of a coaxial compression driver as generally defined in claim 1. Preferred and advantageous embodiments of the aforesaid coaxial compression driver are defined in the appended dependent claims.

The invention will be better understood from the following detailed description of a particular embodiment thereof, made by way of explanation and therefore in no way limiting, with reference to the accompanying drawings, synthetically described in the following paragraph.

DETAILED DESCRIPTION

Figure 1:
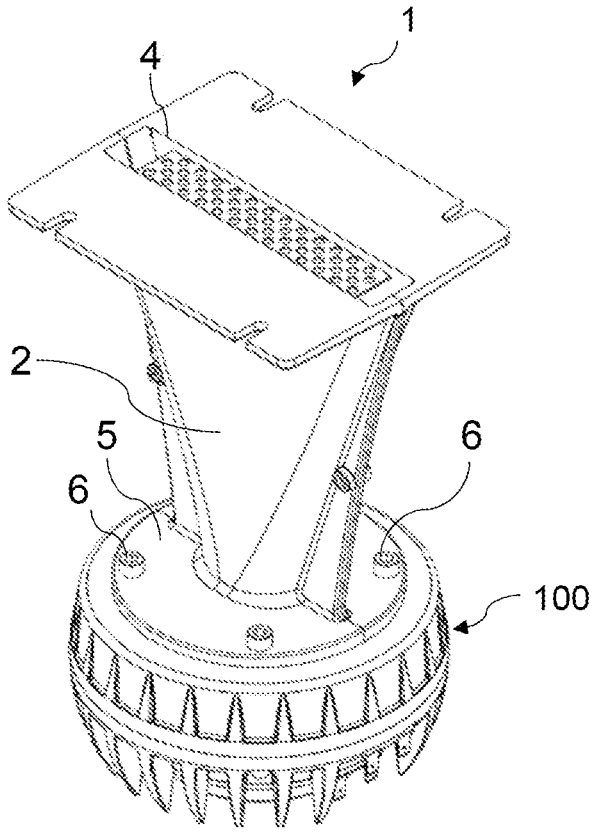
FIG. 1 shows a three-dimensional top view of a non-limiting embodiment of an electroacoustic transducer, comprising a horn and a coaxial compression driver coupled to the horn.
Figure 2:
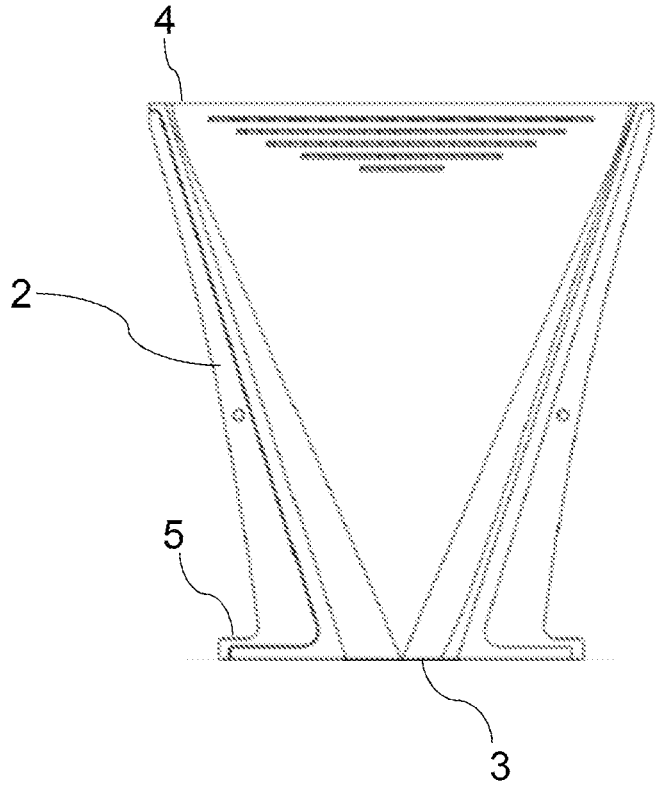
FIG. 2 shows a plane side sectional view of the horn in FIG. 1.
Figure 3:
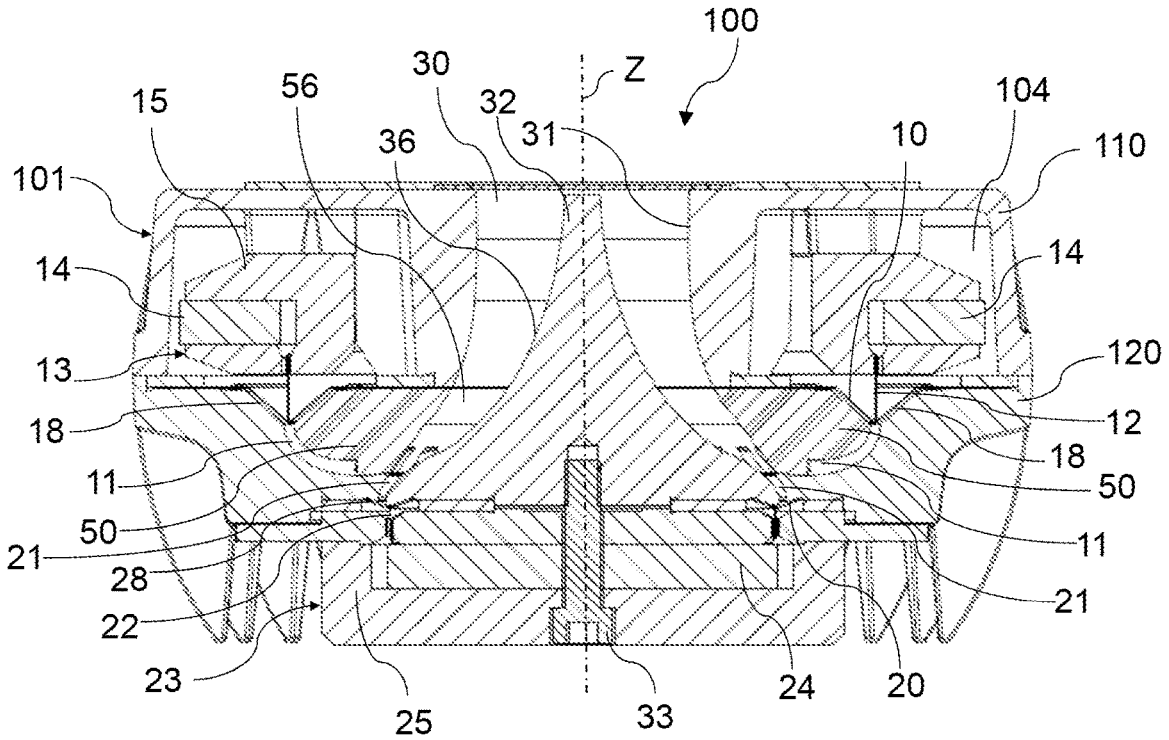
FIG. 3 shows a plane side sectional view of the coaxial compression driver in FIG. 1.
Figure 4:
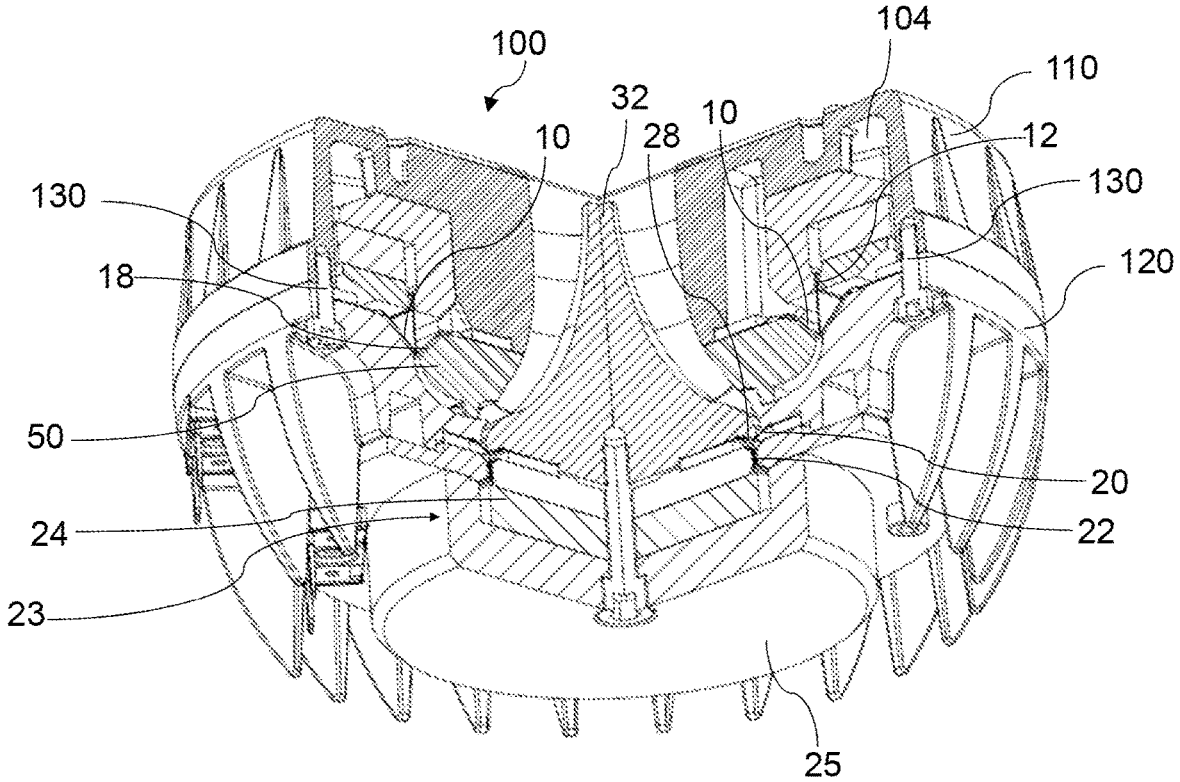
FIG. 4 shows a three-dimensional sectional view of the coaxial compression driver in FIG. 1.
Figure 5:
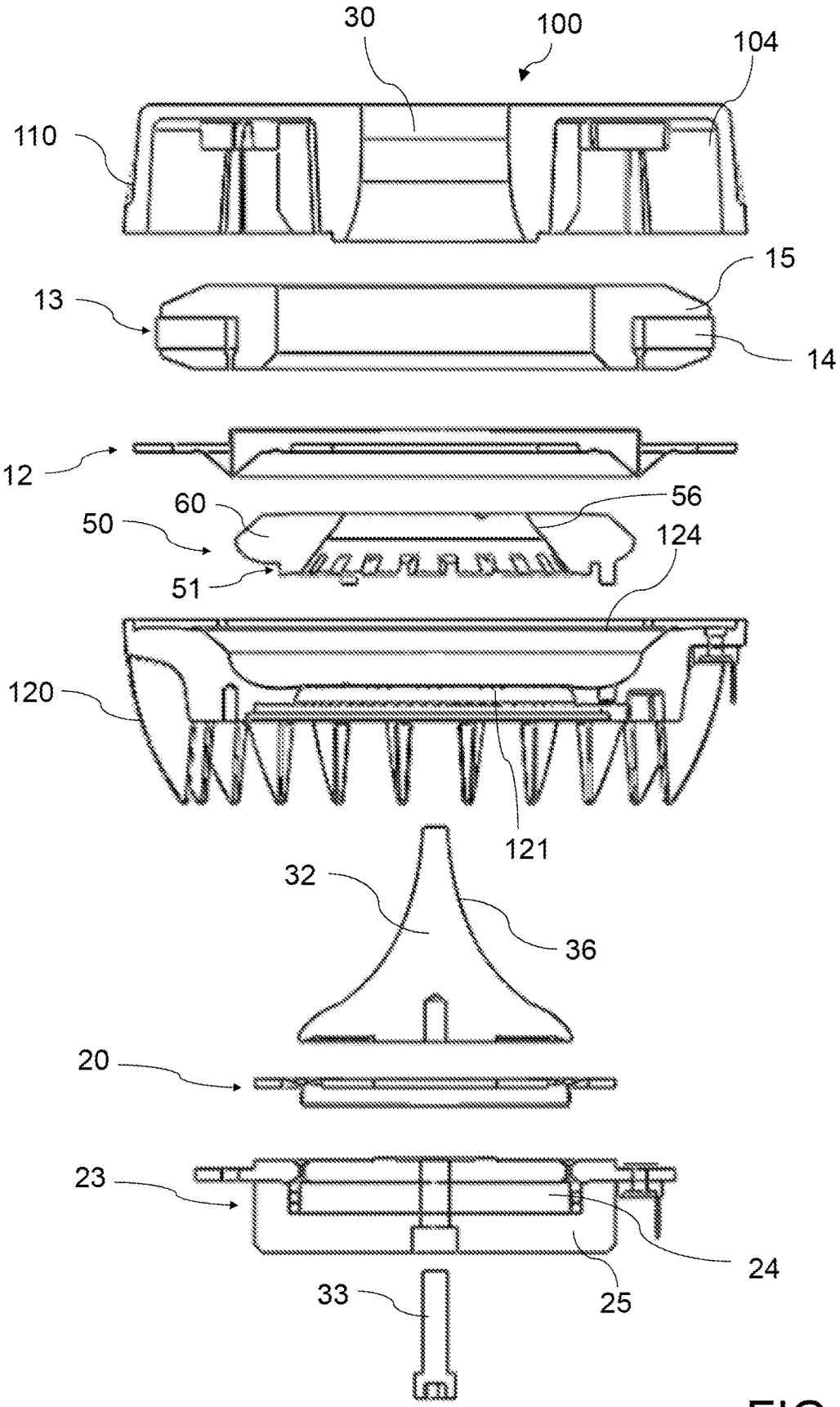
FIG. 5 shows an exploded plane side sectional view of the coaxial compression driver in FIG. 1.

FIG. 1 shows an embodiment given by way of explanation and not by way of limitation of an electroacoustic transducer 1.

In the particular embodiment shown, the electroacoustic transducer 1 comprises a compression driver 100 and a horn 2, operatively coupled to each other, for example, by means of a mechanical coupling system. In the particular example shown in FIG. 1 the horn 2 is mechanically coupled by means of a coupling flange 5 and an associated system of screws 6.

The horn 2 has an internally hollow main body which extends between an input opening 3 adapted to receive acoustic radiation emitted by the coaxial compression driver 100 and an opposite output opening 4 for the diffusion of such an acoustic radiation outside the horn 2. The input opening 3 is generally referred to as a throat while the output opening 4 is generally referred to as a mouth.

The main body of the horn 2 has walls which delimit a flared conduit which allows the propagation of acoustic radiation emitted between the input opening 3 and the output opening 4, i.e., between the throat and the mouth. In the non-limiting example shown in the accompanying Figures, the output opening 4 has a quadrangular shape, in the example, rectangular.

The main body of the horn 2 may be made of plastic or metallic material, for example, of aluminum.

The coaxial compression driver 100 comprises a housing 101.

The coaxial compression driver 100 comprises a first vibrating membrane 10 for relatively lower frequencies housed in the housing 101. For example, without however introducing any limitation, the frequency response of the first vibrating membrane 10 is of 300.00 Hz-5,500.00 Hz.

The first vibrating membrane 10 faces a first compression chamber 18 in communication with a first acoustic conduit 11.

In accordance with a preferred embodiment, the first vibrating membrane 10 is an annular membrane.

The first vibrating membrane 10 preferably has a first coil 12 and the coaxial compression driver 100 comprises a first magnetic assembly 13, or magnetic motor 13, comprising a permanent magnet 14 and a ferromagnetic structure 15. When the first coil 12 is fed by an electric signal, it is configured to move axially with respect to the first magnetic assembly 13 and to vibrate the first membrane 10.

The coaxial compression driver 100 further comprises a second vibrating membrane 20 for relatively higher frequencies housed in the housing 101. For example, without however introducing any limitation, the frequency response of the second vibrating membrane 20 is of 3,000.00 Hz-20,000.00 Hz.

The second vibrating membrane 20 faces a second compression chamber 28 in communication with a second acoustic conduit 21.

In accordance with a preferred embodiment, the second vibrating membrane 20 is an annular membrane.

The second vibrating membrane 20 preferably has a second coil 22 and the coaxial compression driver 100 comprises a second magnetic assembly 23, or magnetic motor 23, comprising a permanent magnet 24 and a ferromagnetic structure 25. When the second coil 22 is fed by an electric signal, it is configured to move axially with respect to the second magnetic assembly 23 and to vibrate the second membrane 20.

The first vibrating membrane 10 and the second vibrating membrane 20 are arranged in the housing 101 being coaxial or substantially coaxial with respect to each other. They are, in particular, aligned along an alignment axis Z which represents the acoustic axis of the compression driver 100 or "driver axis".

Preferably, the first vibrating membrane 10 and the second vibrating membrane 20 are axially spaced with respect to each other. In an embodiment, the first and second vibrating membranes may also not be axially spaced, i.e., they may be axially aligned. In any case, preferably, the first vibrating membrane 10 has a greater diameter than the second vibrating membrane 20.

In accordance with an advantageous embodiment, the housing 101 comprises a first housing portion 110 and a second housing portion 120 fastened to each other by means of suitable fastening means, for example, by means of one or more screws 130. The first housing portion 110 and the second housing portion 120 are preferably made of metallic material, for example, of aluminum, alternatively, they may be made of plastic material.

Preferably, the first housing portion 110 includes a compartment 104 for housing the first magnetic assembly 13. More preferably, the first magnetic assembly 13 is interposed between the first housing portion 110 and the second housing portion 120.

Preferably, the second magnetic assembly 23 is fastened to the second housing portion 120. Preferably, the second housing portion 120 comprises an opening 121 which is occluded from the second vibrating membrane 20, when the latter is fastened to the second housing portion 120.

The first acoustic conduit 11 and the second acoustic conduit 21 converge into a common output acoustic conduit 30. Such a common output acoustic conduit 30 is delimited by a first side wall 31. In accordance with an advantageous embodiment, the common output acoustic conduit 30 is a flared conduit.

In accordance with an advantageous embodiment, the coaxial compression driver 100 comprises a central body 32, or ogive 32, which delimits the common output acoustic conduit 30. In the example shown in the Figures, the ogive 32 is fastened to the second magnetic assembly 23 by means of a screw 33 which passes through the second magnetic assembly 23.

Preferably, the ogive 32 is a conical element with an axial symmetry, more preferably having a side wall 36 at least partly concave. The ogive 32 is, for example, made of metallic material, for example, of aluminum.

In accordance with a preferred embodiment, the common acoustic conduit 30 is radially delimited towards the outside by the first side wall 31 and towards the inside by the side wall 36 of the ogive 32.

The coaxial compression driver 100 comprises a passive low pass filter 50 at least partially housed in the first acoustic conduit 11. Such a passive low pass filter 50 advantageously allows to avoid frequencies above a predetermined cutoff frequency from passing from the second acoustic conduit 21 to the first acoustic conduit 11 or at least to limit said passage. Such a filter 50 is preferably transparent at frequencies lower than (lower than or equal to) the predetermined cutoff frequency, so as to allow the passage of such frequencies from the first acoustic conduit 11 to the common acoustic conduit 30. For example, such a cutoff frequency is in the range of 5,000.00-6,000.00 Hz, and for example is equal to 5,500.00 Hz. Preferably, the passive low pass filter 50 is integrated inside the coaxial compression driver 100, in other words it is housed inside the housing 101.

According to a particularly advantageous embodiment, the passive low pass filter 50 has a filtering part 51 and a remaining part for supporting 60 the filtering part 51.

In accordance with a particularly advantageous embodiment, the filtering part 51 is entirely housed in the first acoustic conduit 11. In such an embodiment, the part for supporting 60 the filtering part 51 may be housed outside of the first acoustic conduit 11 or, alternatively, the supporting part 60 may also be housed inside the first acoustic conduit 11. In any case, the fact that the passive low pass filter 50 is arranged outside of both the second acoustic conduit 21 and of the common acoustic conduit 30 is advantageous. Thereby, the assembly formed by the passive low pass filter 50, the first compression chamber 18, the first acoustic conduit 11, the second compression chamber 28, the second acoustic conduit 21, the common output acoustic conduit 30 advantageously defines a phase plug of the coaxial compression driver 100.

According to an advantageous embodiment, the common acoustic conduit 30 extends inside the housing 101 of the driver 100 between an inlet opening and an outlet opening and the filter, the first acoustic duct and the second acoustic duct are arranged relatively closer to the inlet opening and relatively farther from the outlet opening. The outlet opening of the common acoustic duct is in particular the opening destined to be facing the input opening 3 of the horn 2 when the driver 100 is coupled to the horn 2.

In accordance with a particularly advantageous embodiment, the passive low pass filter 50 has an annular shape, in particular, a circular shape. Such a filter 50 is preferably a self-standing component housed inside the housing 101, more preferably in a housing seat 124 defined inside the second housing portion 120.

The passive low pass filter 50 is preferably made in one piece, for example, made of plastic material, for example, of polypropylene.

in accordance with an embodiment, the passive low pass filter 50 is axially interposed between the first vibrating membrane 10 and the second vibrating membrane 20.

Figure 6:
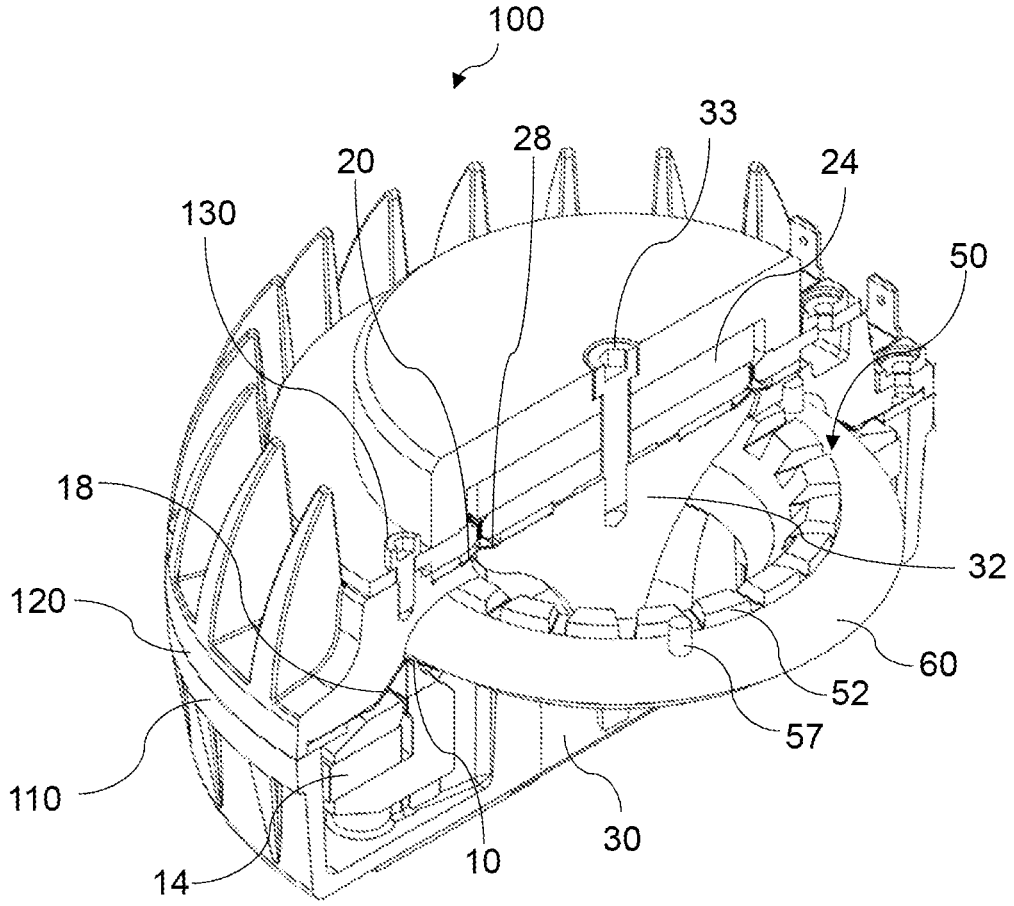
FIG. 6 shows a three-dimensional view, with a sectional view of some parts, of the coaxial compression driver in FIG. 1.
Figure 7:
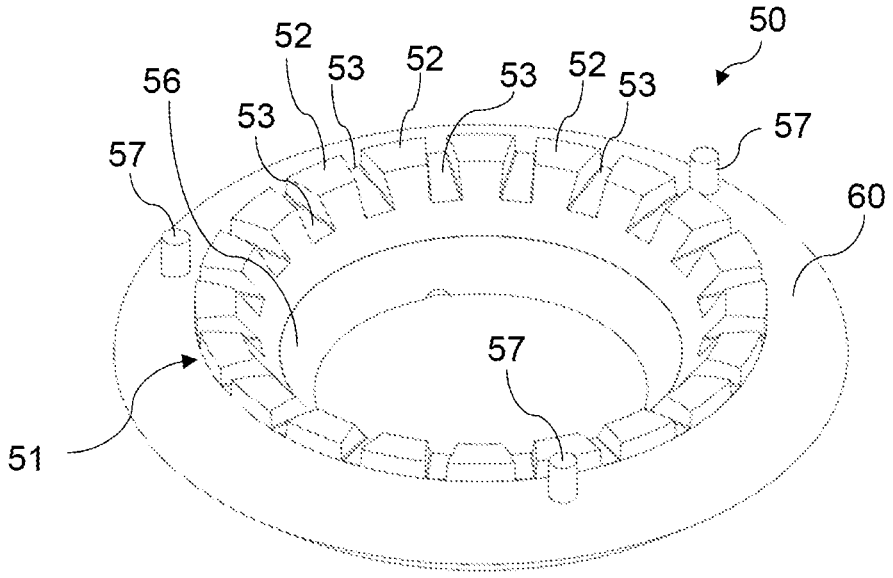
FIG. 7 shows a three-dimensional view of a possible embodiment of a passive low pass filter which may be employed in the coaxial compression driver in FIG. 1.

In accordance with an advantageous embodiment, in accordance with the example shown in FIGS. 6 and 7, the passive low pass filter 50 comprises an array of teeth 52 defining through channels 53 therebetween, which connect the first acoustic conduit 11 with the common output acoustic conduit 30. Preferably, the array of teeth 52 is a circular array. Such teeth 52 are advantageously arranged inside the first acoustic conduit 11, preferably completely inside the latter. It should be noted that the teeth 52 are means placed inside the first acoustic conduit 11 adapted to partially obstruct such an acoustic conduit 11, in particular, such means are adapted and configured to block frequencies higher than the cutoff frequency of the passive low pass filter 50 from the second acoustic conduit 21 to the first acoustic conduit 11 and to allow the passage of frequencies lower than the cutoff frequency from the first acoustic conduit 11 to the common acoustic conduit 30.

In accordance with an advantageous embodiment, the aforesaid array of teeth 52 forms the filtering part 51 of the passive low pass filter 50. Preferably, the teeth 52 protrude from the supporting part 60 of the passive low pass filter 50.

In accordance with a particularly advantageous embodiment, the aforesaid channels 53 have a cross section which expands, preferably gradually, in the direction from the first acoustic conduit 11 to the common output acoustic conduit 30.

Figure 8:
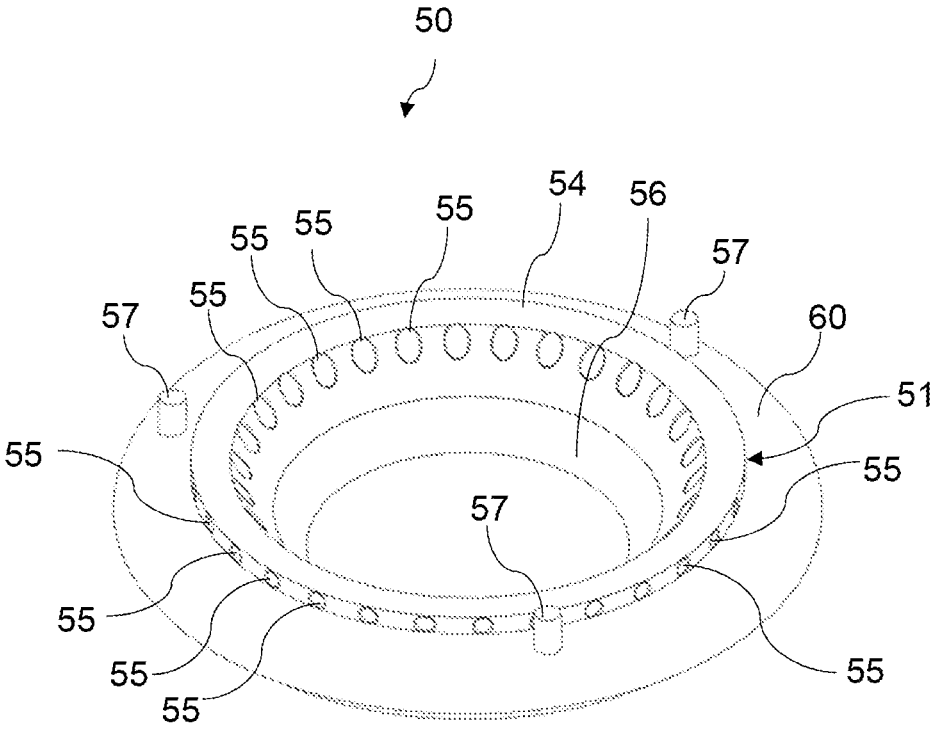
FIG. 8 shows a three-dimensional view of a possible embodiment of the passive low pass filter in FIG. 7.

In the alternative embodiment shown in FIG. 8, the filter 50 comprises a collar 54, or perforated collar 54, inside which an array of through channels 55 is defined. Preferably, the perforated collar 54 is a circular collar, as well as the array of through channels 55 is also circular.

Such a perforated collar 54 is advantageously arranged inside the first acoustic conduit 11, preferably completely inside. It should be noted that the perforated collar 54 shows another example of means placed inside the first acoustic conduit 11 adapted to partially obstruct such an acoustic conduit 11.

In accordance with an advantageous embodiment, the aforesaid perforated collar 54 forms the filtering part 51 of the filter 50. Preferably, such a perforated collar 54 protrudes from the supporting part 60 of the passive low pass filter 50.

In accordance with a particularly advantageous embodiment, the aforesaid channels 55 of the perforated collar 54 have a cross section which expands, preferably gradually, in the direction from the first acoustic conduit 11 to the common acoustic conduit 30.

In accordance with a particularly advantageous embodiment, the passive low pass filter 50, and, in particular, the filtering part 51 thereof, is housed in a portion of the first acoustic conduit 11 which is proximal to the common output acoustic conduit 30. Preferably, the passive low pass filter 50, and, in particular, the filtering part 51 thereof, is arranged at an end portion of the first acoustic conduit 11.

Preferably, the passive low pass filter 50 is a lumped parameters filter, i.e. a subwavelength filter. In other words, the maximum dimensions of the passive low pass filter 50 along the axis of the driver 100, and more preferably the dimensions of the filtering part 51, and more preferably the dimensions of the channels 53, 55, are lower than the wavelengths of interest in the operation of the driver 100. In systems for audio reproduction, the smallest wavelength of interest is about 17 mm (corresponding to the frequency of 20 kHz). Thus, in this embodiment, the maximum dimensions of the filter 50 along the Z axis of the driver, and preferably the dimensions of the filtering part 61, and more preferably the dimensions of the channels 53, 55, are less than 17 mm and preferably lower than 10 mm, for example in the order of 5 mm.

As already mentioned, the common output acoustic conduit 30 is delimited by a first side wall 31. An embodiment in which the passive low pass filter 50 has a wall 56 which forms a portion of said first side wall 31 is particularly advantageous. Conveniently, such a wall 56 is a flared wall, for example a flared annular wall. Preferably, the aforesaid portion of said first side wall 31 is continuously joined to a remaining portion of said first side wall 31.

In the embodiment in which the acoustic transducer includes an ogive 32, providing for the passive low pass filter 50 surrounding said ogive 32 so that a radial distance is defined therebetween is advantageous.

In accordance with an advantageous embodiment, the passive low pass filter 50 further comprises centering means 57 adapted to center said filter 50 with respect to the housing 101. Thereby, it is possible to ensure a precise positioning of the passive low pass filter 50 inside the housing 101. For example, such centering means 57 comprise a plurality of pins adapted to be engaged in conjugated seats provided in the first housing portion 110 and/or in the second housing portion 120.

From the above description it is apparent that a coaxial compression driver 100 of the type described above allows to fully achieve the prefixed objects in terms of overcoming the drawbacks of the background art. In fact, by virtue of the presence of the passive low pass filter 50 it has been possible to significantly reduce the interference phenomena and therefore to improve the frequency response of the coaxial compression driver 100, in particular, at the relatively higher frequencies.

Without prejudice to the principle of the invention, the embodiments and constructional details may be widely varied with respect to the above description merely disclosed by way of non-limiting example, without departing from the scope of the invention as defined in the appended claims.

The invention claimed is:

1. A coaxial compression driver comprising:

a housing;

a first vibrating membrane for relatively lower frequencies housed in the housing, wherein the first vibrating membrane faces a first compression chamber in communication with a first acoustic conduit;

a second vibrating membrane for relatively higher frequencies housed in the housing, wherein the second vibrating membrane faces a second compression chamber in communication with a second acoustic conduit; and a passive acoustic low pass filter at least partially housed in the first acoustic conduit;

wherein the first vibrating membrane and the second vibrating membrane are arranged in the housing coaxial or substantially coaxial with respect to each other;

wherein the first acoustic conduit and the second acoustic conduit converge into a common output acoustic conduit;

wherein the passive low pass filter is a lumped parameters filter designed and configured to substantially prevent frequencies above a predetermined cutoff frequency from passing from the second acoustic conduit to the first acoustic conduit and to allow frequencies below the predetermined cutoff frequency to pass from the first acoustic conduit to the common output acoustic conduit.

2. A coaxial compression driver according to claim 1, wherein the lumped parameters filter is of first or second order roll off behavior.

3. A coaxial compression driver according to claim 1, wherein the lumped parameters filter has a defined quality factor (Q).

4. A coaxial compression driver according to claim 1, wherein the lumped parameters filter exhibits peaking, or notching, frequency response in the passband, stopband, or through the frequency range of the cutoff transition.

5. A coaxial compression driver according to claim 1, wherein the passive low pass filter comprises:

an array of teeth defining through channels therebetween, which connect the first acoustic conduit with the common output acoustic conduit; or a collar, or perforated collar, inside which an array of through channels is defined.

6. A coaxial compression driver according to claim 5, wherein the lumped parameters filter is of first or second order roll off behavior, and wherein the array of through channels are configured to create the roll off behavior.

7. A coaxial compression driver according to claim 5, wherein the lumped parameters filter has a defined quality factor (Q), and wherein the array of through channels are configured to create the defined quality factor (Q).

8. A coaxial compression driver according to claim 5, wherein the lumped parameters filter exhibits peaking, or notching, frequency response in the passband, stopband, or through the frequency range of the cutoff transition, and wherein the array of through channels are configured to create the specified frequency response.

* * * * *